United States Patent [19]

Caple

[11] Patent Number: 4,760,305

[45] Date of Patent: Jul. 26, 1988

[54] CATHODE RAY DISPLAY TUBES

[75] Inventor: Adrian Caple, Purley, England

[73] Assignee: U.S. Philips Corporation, New York, N.Y.

[21] Appl. No.: 905,092

[22] Filed: Sep. 8, 1986

[30] Foreign Application Priority Data

Sep. 11, 1985 [GB] United Kingdom ..... 8522541

[51] Int. Cl.[4] ..... H01J 43/00

[52] U.S. Cl. ..... 313/103 CM; 313/269; 313/422

[58] Field of Search ..... 313/51, 103 CM, 105 CM, 313/422, 269, 404, 407, 476, 482, 50, 528

[56] References Cited

U.S. PATENT DOCUMENTS 3,825,922 7/1974 Ralph ..... 313/103 X 4,550,251 10/1985 Zitelli et al. ..... 313/105 CM X

FOREIGN PATENT DOCUMENTS 1404738 9/1975 United Kingdom .

2101396 1/1983 United Kingdom .

*Primary Examiner*—David K. Moore

*Assistant Examiner*—Michael Horabik

*Attorney, Agent, or Firm*—John C. Fox

[57] ABSTRACT

In a cathode ray display tube including a screen carried on a flat faceplate of an envelope and a channel plate electron multiplier arranged parallel to, and spaced from, the screen having an input side across which an electron beam is scanned and an output side from which a current multiplied beam is directed onto the screen, the multiplier is supported away from the screen by a spacing frame engaging with the periphery of its output side and is clamped against the frame by a pressure member having a plurality of resilient fingers spaced at intervals around the edges of the multiplier and engaging with the input side thereof. In this way, minor local surface profile variations of the multiplier are accomodated. The fingers serve also as contacts for the input side electrode of the multiplier.

5 Claims, 4 Drawing Sheets

CATHODE RAY DISPLAY TUBES

BACKGROUND OF THE INVENTION

This invention relates to a cahtode ray display tube having an envelope with a subtantially planar faceplate carrying a phosphor screen, a channel plate electron multiplier disposed substantially parallel to, and spaced from, the screen, the channel electron multiplier having an input side over which, in use of the tube, an electron beam is scanned and an output side facing the screen from which a current multiplied electron beam is directed onto the screen.

The invention is concerned especially, but not exclusively, with a so-called "flat" cathode ray display tube generally of the kind described in published British Patent Application No. 2101396A, corresponding to U.S. patent application Ser. No. 830,388, filed Feb. 14, 1986. With this kind of display tube, a low energy electron beam is directed along a path parallel to the screen and is turned through 180° so that it then travels in the opposite direction. The beam is subsequently deflected onto the input side of the channel plate multiplier where it undergoes electron multiplication before being accelerated onto the screen to excite the phosphor material by a field established between the output of the multiplier and a screen electrode. With such an arrangement, a compact, flat tube is achieved.

In one realised version of this flat tube, the electron multiplier comprises a glass micro-channel plate multiplier formed with thousands of individual channels extending therethrough. It is important for optimum operation of the display tube that the channel plate multiplier be maintained accurately parallel to, and in predetermined spatial relationship with, the planar faceplate, and thus the screen.

Heretofore, the multiplier has been held rigidly clamped relative to the screen. However, being formed of thin glass (around 1 mm), the multiplier is comparatively fragile and there is a risk with this kind of rigid clamping that the multiplier may fracture during assembly, particularly if its surfaces or those of the clamping elements are not precisely even, for example if one or both of the multiplier's input and output surfaces have small undulations. Moreover, there is a risk also that the multiplier can be damaged as a result of the tube being subjected to mechanical shock or vibration or as a result of differences in thermal expansion rates of the multiplier and the clamping arrangement. An object of the present invention is to overcome to some extent the above mentioned problems.

SUMMARY OF THE INVENTION

According to the present invention, a cathode ray display tube having an envelope with a substantially planar faceplate carrying a phosphor screen, a channel plate electron multiplier disposed substantially parallel to, and spaced from, the screen, the channel plate electron multiplier having an input side over which, in use of the tube, an electron beam is scanned and an output side facing the screen from which a current multiplied electron beam is directed onto the screen, is characterised in that the channel plate multiplier is spaced from the faceplate by a spacing frame extending between the faceplate and the multiplier and engaging with the multiplier around the periphery of its output side, and in that a pressure member is provided which has a plurality of resilient fingers which engage with the input side of the multiplier at spaced locations around its periphery to urge the multiplier against the spacing frame.

The resilient fingers are able to accomodate any minor local surface profile variations of the input and output sides of the multiplier or the multiplier engaging surface of the spacing frame without exerting excessive stress on the multiplier, and the risk of fracture is therefore reduced. The fingers serve to maintain the multiplier in abutting relation with the spacing frame, and hence with the desired spatial separation from the faceplate, whilst at the same time, they are capable of exerting sufficient pressure to maintain the abutted components in contact during any mechanical shocks and vibrations to which the tube may be subjected.

The pressure member preferably comprises a substantially planar part extending along adjacent marginal portions of the input side of the channel plate multiplier with the resilient fingers being carried by said part and bent such that the portions of the fingers engaging the multiplier are located away from the plane of the part.

The bent portions of the resilient fingers may be dome shaped to provide a precisely defined contact area with the multiplier.

The resilient fingers are advantageously of metal and serve as contacts so that electrical potentials may be applied to the input side electrode of the multiplier easily via the metal fingers.

In order to apply evenly distributed pressure, the fingers in a preferred embodiment are spaced at regular intervals completely around the periphery of the input side of the multiplier and define an opening through which that side is exposed to an incoming electron beam.

The resilient fingers may comprise parts of metal strip material secured to the planar member, for example by spot welding, the fingers being defined by transverse divisions, formed for example by cutting or etching, extending partway across the width of the strip. The metal strip material may be continuous, i.e. a unitary rectangular strip formed by stamping, or alternatively may be formed in individual sections. The latter construction is particularly advantageous as it utilises material more efficiently and allows differently sized pressure members to be fabricated for use with corresponding differently sized multipliers easily in the same manner as picture framing.

BRIEF DESCRIPTION OF DRAWINGS

A cathode ray display tube in accordance with the present invention will now be described, by way of example, with reference to the accompanying drawings in which.

Figure 1:
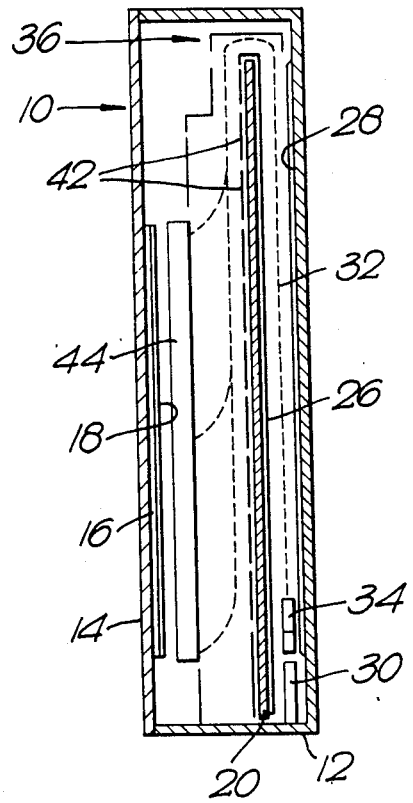
FIG. 1 shows schematically a cross-secton through a flat display tube including a channel plate electron multiplier.

The flat display tube 10 shown in FIG. 1 is of the type described in published British Patent Specification No. 2101396A corresponding to U.S. patent application Ser. No. 830,388, filed Feb. 14, 1986, (PHB32794). A brief description of the display tube and its operation will now be given but for a fuller description reference should be made to Specification No. 2101396A corresponding to U.S. patent application Ser. No. 830,388, filed Feb. 14, 1986, details of which are incorporated herein by way of reference.

The flat display tube 10 comprises an envelope 12 including a planar glass faceplate 14 which carries on its inside surface a phosphor screen 16 including an electrically conductive backing electrode 18 constituting the screen acceleration electrode.

A partition 20 separates the envelope 12 into front and rear parts. An electron gun 30 is provided in the rear part which directs a low-energy electron beam 32 upwardly of the rear part parallel to the faceplate 14, electrodes 26 and 28 on the partition 20 and rear wall of the envelope respectively define a field free region. an electrostatic deflection electrode arrangement 34 adjacent the electron gun 30 serves to deflect the electron beam in a plane parallel to the plane of the cross section to achieve line deflection.

At the upper end of the envelope, there is provided a reversing lens arrangement 36 which is operable to turn the electron beam through 180° so that it travels in the opposite direction adjacent the other, front side of the partition 20. On the front side of the partition 20 there are provided a plurality of laterally elongate, vertically spaced, electrodes 42 which are selectively energisable to achieve frame deflection of the electron beam 32 onto the input surface of a channel plate electron multiplier 44.

The electron beam 32 undergoes current multiplication by the multiplier 44 and upon leaving the multiplier is accelerated by the screen electrode 18 onto the phosphor screen 16 to excite the phosphor material.

In this particular version, the electron multiplier comprises a glass micro-channel plate multiplier having a matrix of millions of channels of, say, 12 μm diameter and 15 μm pitch. The fabrication of glass matrix electron miltipliers is generally well known and accordingly will not be described here in detail. For further information in this respect, reference is invited to, for example, Acta Electronica Volume 14, No. 2, April 1971. Briefly however, the multiplier comprises a thin, planar, sheet of lead-oxide glass, around 0.5 to 1 mm thickness, having electrodes covering its input and output surfaces. By applying appropriate potentials to these electrodes, an electron beam entering one of its channels is caused to undergo electron multiplication so that the electron beam emanating from the channel is of high energy, high current.

Figure 2:
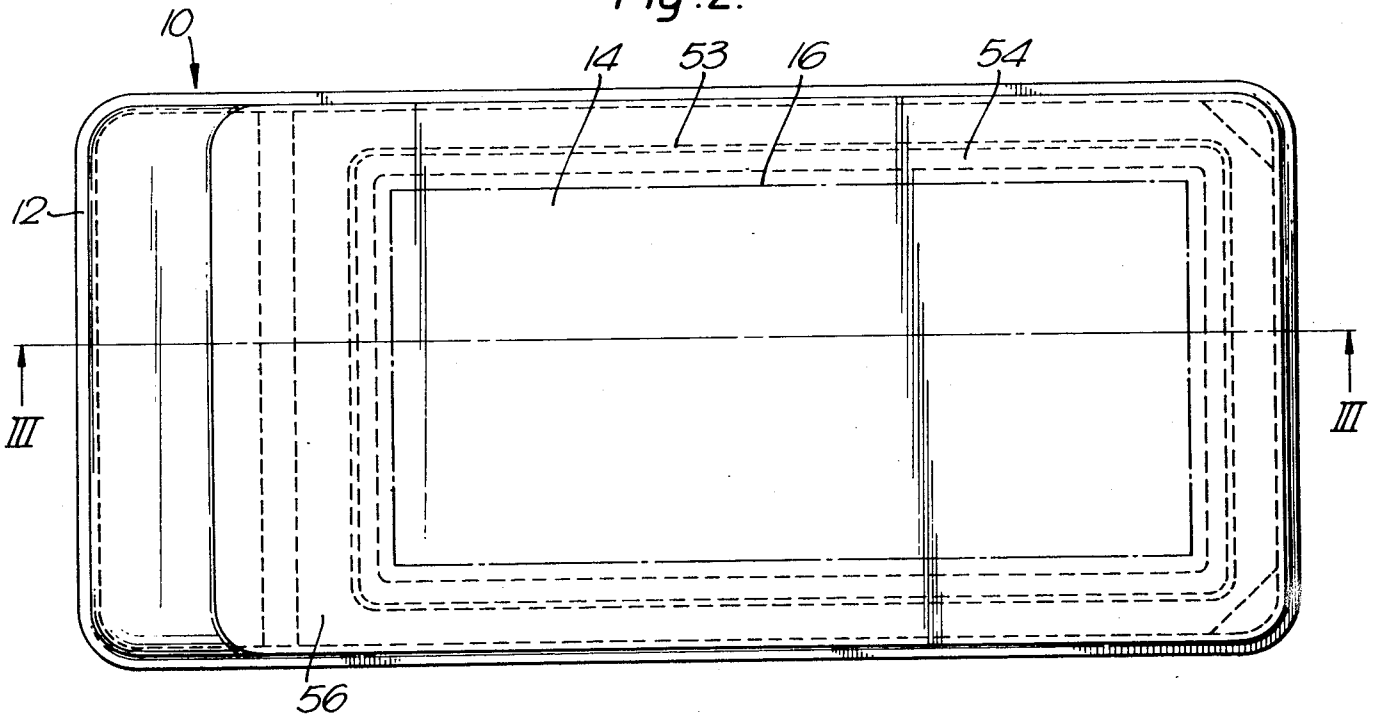
FIG. 2 is a plan view of part of the display tube of FIG. 1.
Figure 3:
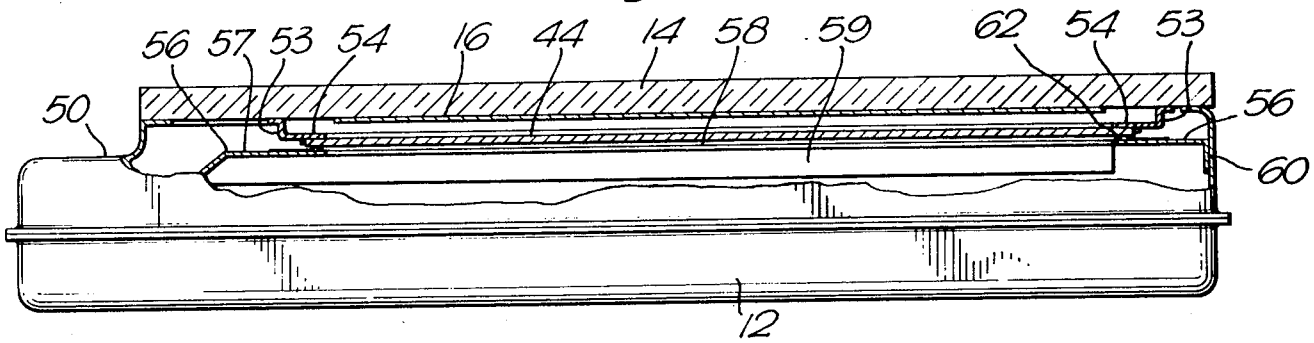
FIG. 3 is a part sectional side elevation of the display tube of FIG. 2 taken along the line III—III of FIG. 2 showing in section the channel plate multiplier mounting arrangement.

Referring to FIG. 2, there is shown a plan view of an embodiment of the display tube of FIG. 1 in which the rectangular shape of the screen 16, around for example 135 mm by 65 mm, and faceplate 14 can clearly be seen. FIG. 3 shows in cross-section an upper part of the display tube, namely the faceplate/channel electron multiplier sub-assembly. The faceplate is bonded to a pressing 50 of metal alloy or mild steel defining part of the side walls of the envelope 12. This pressing 50 is mated around its peripheral flange with a further pressing defining the remainder of the side walls and rear wall of the envelope 12.

Figure 4:
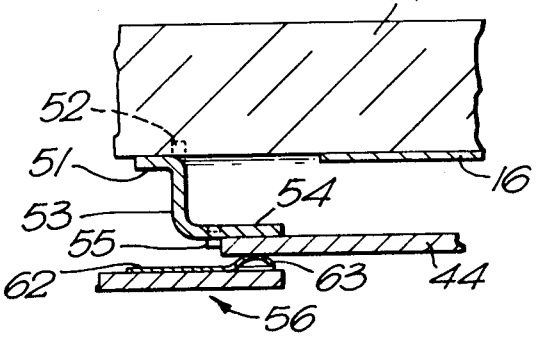
FIG. 4 is an enlarged scrap view showing part of the multiplier mounting arrangement of FIG. 3 in greater detail.

Extending around the screen 16 and spaced laterally therefrom, there is provided a metal spacing frame 53 of "z"-shape section which, as shown more clearly in FIG. 4, engages with the faceplate 14 with its outwardly directed flange 51 at its one side and at its other side has an inwardly directed flange 54 defining a reference surface parallel with the faceplate 14, and thus the screen 16, against which the output surface of the relatively thin glass micro-channel plate electron multiplier 44, corresponding approximately in size to the screen 16, abuts around its perphery. The spacing frame 53 has a number of pipe 52 on its outwardly directed flange 51 which are received in complimentary recesses in the faceplate 14 for accurately locating the spacing frame 53, and hence the multiplier 44, laterally of the screen 16. The spacing frame 53 also serves to support the multiplier 44 parallel with, and at a predetermined spacing from, the faceplate 14.

The spacing frame 53 has a number of locating tabs 55 punched out from the plane of its flange 54 (only one of which is shown) which engage with the four edges of the multiplier 44 to prevent lateral movement of the multiplier.

Figure 5:
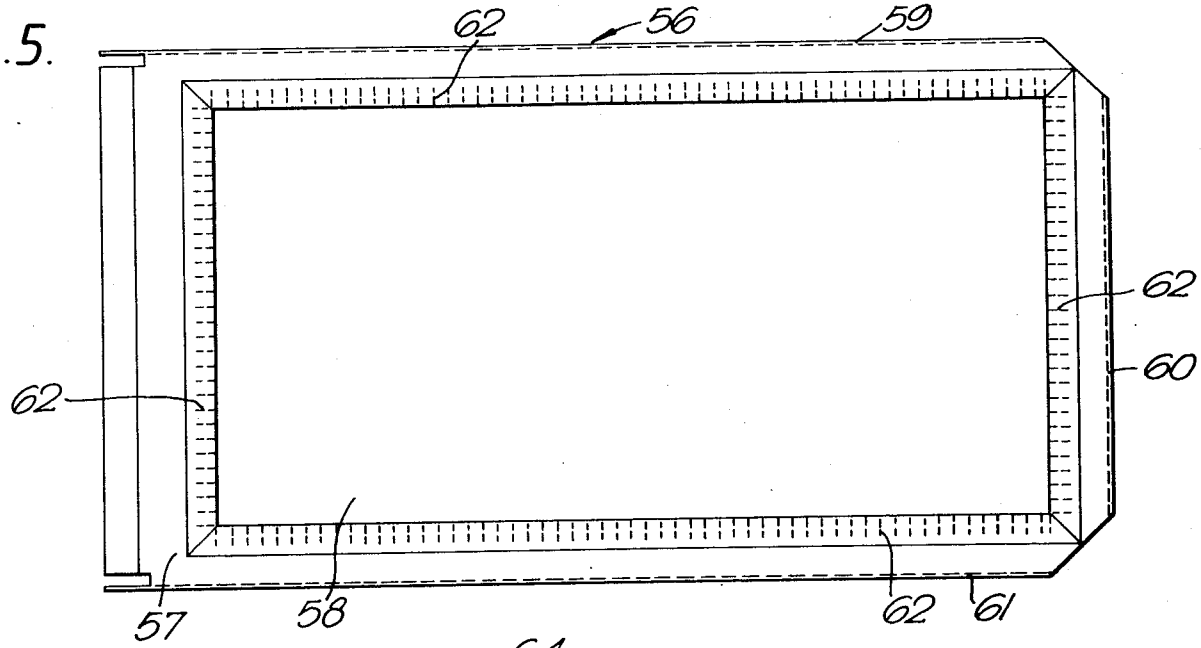
FIG. 5 is a plan view of a pressure member of the channel plate multiplier mounting arrangement.
Figure 6:
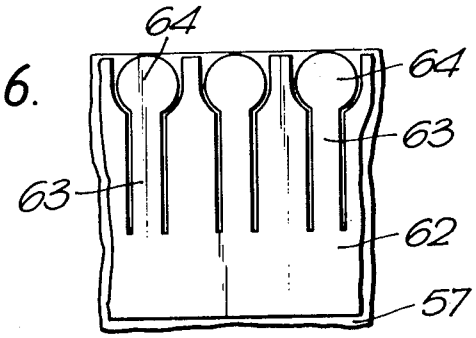
FIG. 6 is an enlarged plan view of a portion of the pressure member of FIG. 5 showing in detail resilient fingers thereof.

The multiplier 44 is held against the spacing frame 53 by a pressure member 56. Although not shown in FIG. 3, the pressure member is supported by structural components co-operating with the wall of the envelope and serves to clamp the multiplier against the inwardly directed flange 54 of the spacing frame 53, and, in turn, to clamp the spacing member 53 aganst the faceplate 14. By appropriately positioning the pressure member 56 with respect to the faceplate 14, the loading on the multiplier 44 is controlled. Referring now also to FIGS. 5 and 6 the pressure member 56 comprises a planar base sheet 57 of stainless steel having a central rectangular opening 58 corresponding in size approximately with the multiplier 44, and formed with flanges 59, 60, and 61 extending along three of its sides away from the faceplate 14 which cooperate respectively with three side walls of the pressing 50 for location purposes.

Referring particularly to FIGS. 4 to 6, the pressure member 56 has securely attached to the planar surface of the sheet 57 facing the faceplate 14 by spot welding four elongate strips 62 of stainless steel which extend completely along the respective four sides of the rectangular opening 58. Each elongate strip 62 has a large number of regularly spaced cantilevered resilient fingers 63 defined by punching or etching the strip along lines transversely of its length and partway across its width at regular intervals, the resilient fingers being arranged so as to project towards the opening 58. Each finger 63 is around 6 mm length and 1 mm width, there being approximately 4 fingers per centimeter. The resilient fingers 63 are bent such that they extend away from the plane of the base sheet 57 towards the faceplate 14 and are each formed adjacent their free end with an enlarged dome-shape (hemispherical) head 64. These dome-shape heads 64 engage with the input surface of the multiplier 44 and provide the sole means of contact between the multiplier 44 and member 56, the surface contact areas as a result being precisely controlled so that, with the sheet 57 at a predetermined position, the multiplier 44 is clamped with a defined contact pressure. The free ends of the fingers 63 are slightly spaced from the sheet 57 in the clamping position and the resilience of the fingers 63 serves to hold the multiplier firmly in position against the flange 54 of spacing frame 53 without excessive stress being caused to the multiplier, whilst any minor unevenness of the input surface of the multiplier 44 is accomodated by individual flexing of the fingers 63. The fingers 63 exert sufficient pressure to maintain clamping engagement in the event of mechanical shocks and vibrations which may be subjected to the tube.

Rather than using separate strips 62 bordering the four sides of the opening 58, a continuous, rectangular strip formed as a single stamping from sheet material may instead be employed.

In use of the tube, electrical potential is applied to the input and output surface electrodes of the multiplier 44 conveniently via respectively the pressure member 56, the resilient fingers 63 thereof serving as contacts for the input surface electrode, and the spacing frame 53, the flange 54 thereof electrically contacting the output surface electrode.

I claim:

1. A cathode ray display tube having an envelope with a substantially planar faceplate carrying a phosphor screen, a channel plate electron multiplier disposed substantially parallel to, and spaced from, the screen, the channel plate electron multiplier having an input side over which, in use of the tube, an electron beam is scanned and an output side facing the screen from which a current multiplied electron beam is directed onto the screen, characterized in that the channel plate multiplier is spaced from the faceplate by a spacing frame extending between the faceplate and the multiplier and engaging with the multiplier around the periphery of its output side, and in that a pressure member is provided which has a plurality of resilient fingers which engage with the input side of the multiplier at closely spaced locations around its entire periphery to urge the multiplier against the spacing frame, and accommodate for any minor unevenness of the input side of the multiplier by individual flexing of the fingers, the pressure member comprising a substantially planar base sheet extending along the periphery of the input side of the multiplier, and further comprising metal strip material extending along and secured to the planar base sheet, the resilient fingers being defined by a plurality of transverse divisions formed partway across the metal strip material, said fingers being bent such that the portions thereof engaging the multiplier are located away from the planar base sheet.

2. A cathode ray display tube according to claim 1, characterised in that the resilient fingers are of metal and serve as contacts for supplying electrical potential to the input side of the multiplier.

3. A cathode ray display tube according to claim 1, characterised in that the metal strip material comprises a plurality of individual elongate metal strips.

4. A cathode ray display tube according to claim 1, characterised in that the resilient fingers are spaced at regular intervals completely around the periphery of the input side of the multiplier and define an opening through which the input side of the multiplier is exposed to an incoming electron beam.

5. A cathode ray display tube according to claim 1, characterised in that the bent portions of the resilient fingers are dome shaped.

* * * * *